US005397254A

United States Patent [19]

Powell

[11] Patent Number: 5,397,254

[45] Date of Patent: Mar. 14, 1995

[54] PIN SOCKET CARRIER SYSTEM

[75] Inventor: Francis R. Powell, Cheshire, Conn.

[73] Assignee: The Whitaker Corporation, Wilmington, Del.

[21] Appl. No.: 184,518

[22] Filed: Jan. 21, 1994

[51] Int. Cl.[6] ..... H01R 9/24

[52] U.S. Cl. ..... 439/885; 439/844

[58] Field of Search ..... 439/844, 885, 876, 83

[56] References Cited

U.S. PATENT DOCUMENTS

| | | | |
|---|---|---|---|
| Re. 32,540 | 11/1987 | Murphy | 206/329 |
| 2,560,520 | 7/1951 | Berkson | 218/28 |
| 4,036,103 | 7/1977 | Gawlick et al. | 89/35 R |
| 4,099,615 | 7/1978 | Lemke et al. | 206/329 |
| 4,442,938 | 4/1984 | Murphy | 206/329 |
| 4,505,531 | 3/1985 | Miller | 439/844 |
| 4,881,643 | 11/1989 | Pfister | 206/343 |
| 4,887,981 | 12/1989 | Damon et al. | 439/885 |
| 4,894,031 | 1/1990 | Damon et al. | 439/885 |
| 4,955,476 | 9/1990 | Nakata et al. | 206/346 |
| 5,169,322 | 12/1992 | Frantz et al. | 439/82 |

*Primary Examiner*—Z. R. Bilinsky
*Attorney, Agent, or Firm*—William B. Noll

[57] ABSTRACT

A pin socket carrier system is disclosed for positioning and mounting an array of pin receiving sockets to a planar electronic device, such as a printed circuit board (PCB). The system comprises a plurality of first drawn metal cup-shaped sockets having a closed end and an outwardly flanged open end, a like plurality of second drawn metal cylindrical sockets mounted at least partially in the first drawn metal cup-shaped sockets. Each of the second drawn metal cylindrical sockets is characterized at one end thereof by plural axial slots to define plural wall sections, where the wall sections are angled inwardly to electrically contact an electronic pin inserted therein, and at the opposite end by at least a first outwardly flared portion, where the first flared portion is configured to lie contiguous with at least a part of the outwardly flared open end. Finally a flexible plastic carrier strip, having a plurality of holes arranged in a predetermined pattern to receive and releasably retain the assembled sockets, is provided. The carrier strip, which is readily removable, is positioned between the outwardly flared open end and the first outwardly flared portion.

5 Claims, 4 Drawing Sheets

PIN SOCKET CARRIER SYSTEM

BACKGROUND OF THE INVENTION

This invention is directed to a two-piece pin socket carrier system, which, by the use of a pair of interfitting drawn metal members, offers considerable cost saving advantages over systems constructed of single machined parts.

The desirable use of pin sockets for mounting to planar electronic devices, such as printed circuit boards (PCB), has been known for years. As a result of the rapid growth of the electronic industry, it was necessary to develop cost-cutting measures to utilize socket carrier techniques for group or mass mounting to PCB.

One such mass mounting technique is disclosed in U.S. Pat. No. 4,442,938, and its reissue version, RE 32,540. The patentee proposes to mount the sockets on a carrier strip, where such strip may be readily removed after mounting of the sockets to the PCB. Specifically, the one-piece, machined socket thereof has a circumferential V-shaped groove provided in the head of the socket adjacent to the entrance opening of the socket. The groove is sized in relation to an opening in the carrier strip such that the socket can be snapped into a carrier strip hole and retained on the carrier strip. A plurality of strip-mounted sockets can then be installed into cooperative mounting openings of a circuit board and after soldering of the sockets into the board, the flexible strip may be peeled from the soldered sockets.

U.S. Pat. No. 4,894,031 represents a further approach to a mass mounting technique utilizing a carrier strip for the sockets, where the sockets each include retention elements on the socket body to retain the socket on the carrier strip and which can also be employed for locking the socket into a mounting hole of a circuit board. The sockets are cold formed or machined to have a plurality of barbs each with a ramp surface to facilitate installation of the sockets into cooperative holes in the carrier strip, and an edge portion for retaining the socket once installed on the carrier strip.

Each of these prior art systems, though offering effective techniques for mass mounting of sockets to a planar electronic device, are expensive. The present invention offers a more cost effective system by the use of a pair of drawn metal members. The manner by which this is achieved will become apparent in the description which follows, particularly when read in conjunction with the accompanying drawings.

SUMMARY OF THE INVENTION

This invention is directed to a low cost pin socket carrier system for positioning and mounting an array of pin receiving sockets to a planar electronic device, such as a printed circuit board (PCB). The system comprises a plurality of first drawn metal cup-shaped sockets having a closed end and an outwardly flanged open end, and a like plurality of second drawn metal cylindrical sockets mounted at least partially in the first drawn metal cup-shaped sockets. The second drawn metal cylindrical sockets are characterized at one end thereof by plural axial slots to define plural wall sections, where the wall sections are angled inwardly to electrically contact an electronic pin inserted therein. The opposite end is characterized by at least a first and outwardly flared portion, where the first flared portion is configured to lie contiguous with at least a part of the outwardly flared open end of the first metal socket. Finally, a removable flexible plastic carrier strip, having a plurality of holes arranged in a predetermined pattern to receive and releasably retain the assembled sockets, is provided about the assembled sockets between the outwardly flared open end and the first outwardly flared portion.

DETAILED DESCRIPTION OF PREFERRED EMBODIMENTS

Figure 1:
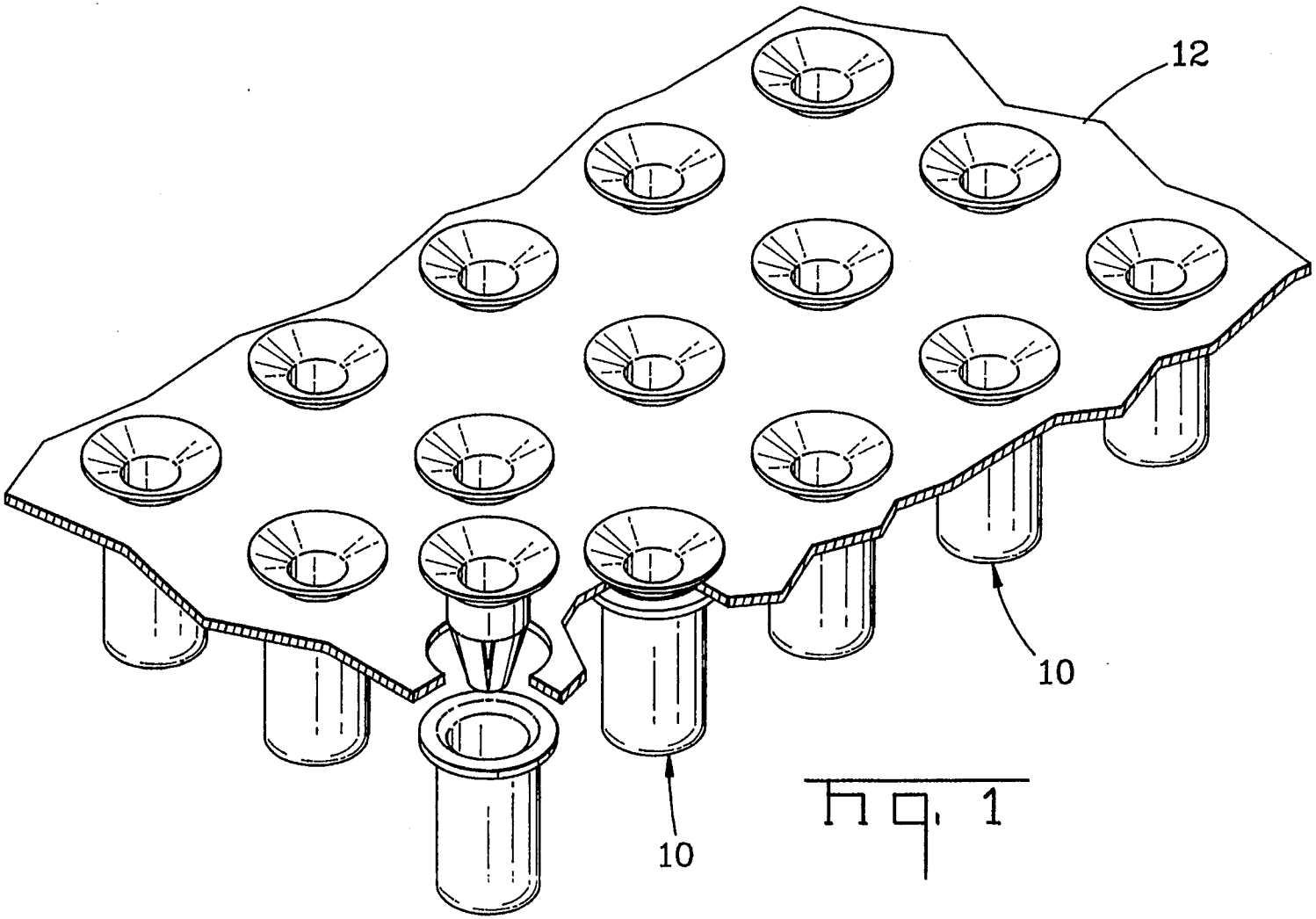
FIG. 1 is a partial cut-away perspective view of a plurality of two-piece pin socket carrier systems in accordance with the present invention.
Figure 2:
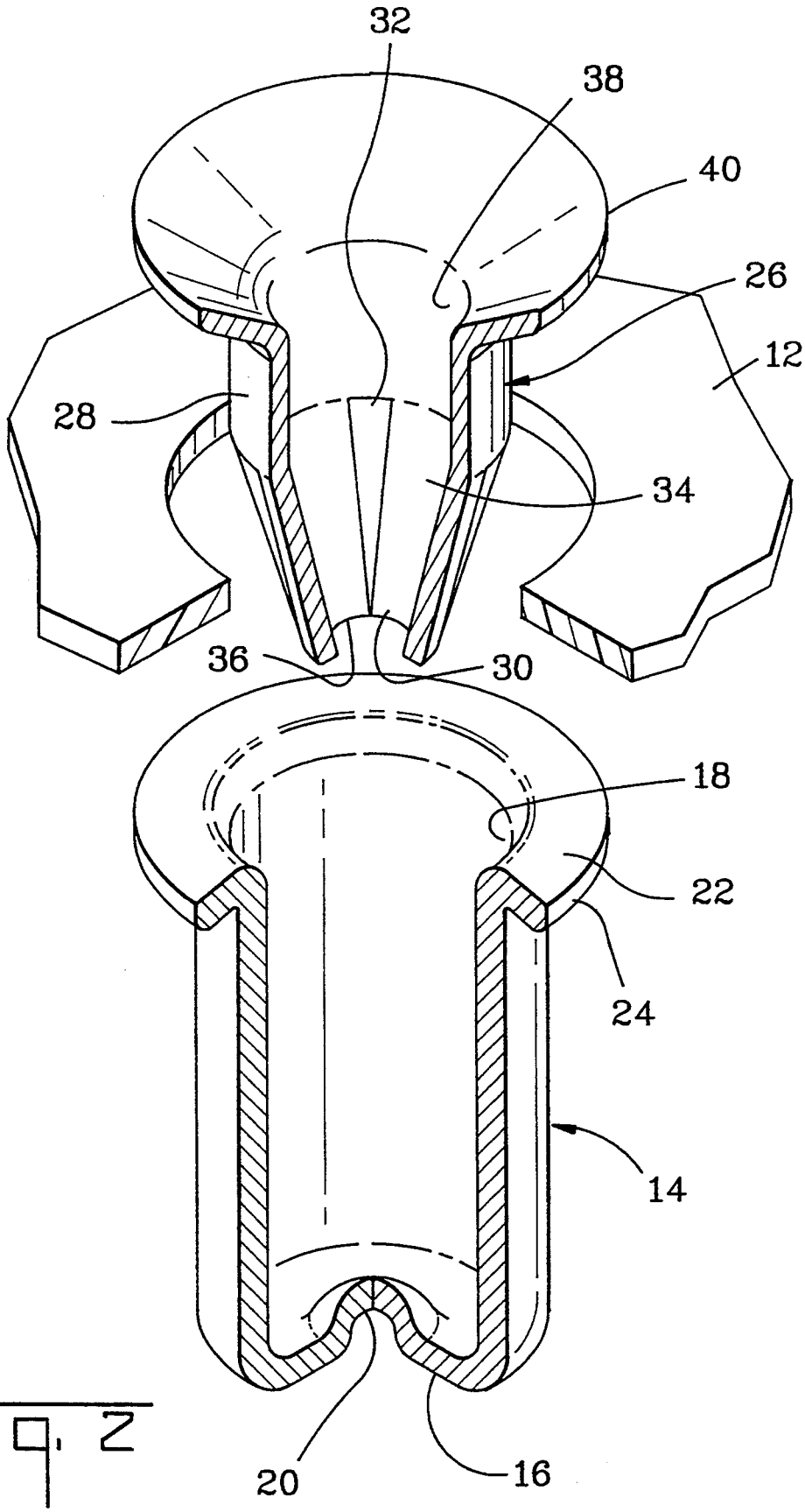
FIG. 2 is an enlarged, partially sectioned, exploded perspective view of a preferred two-piece pin socket carrier system according to this invention.
Figure 3:
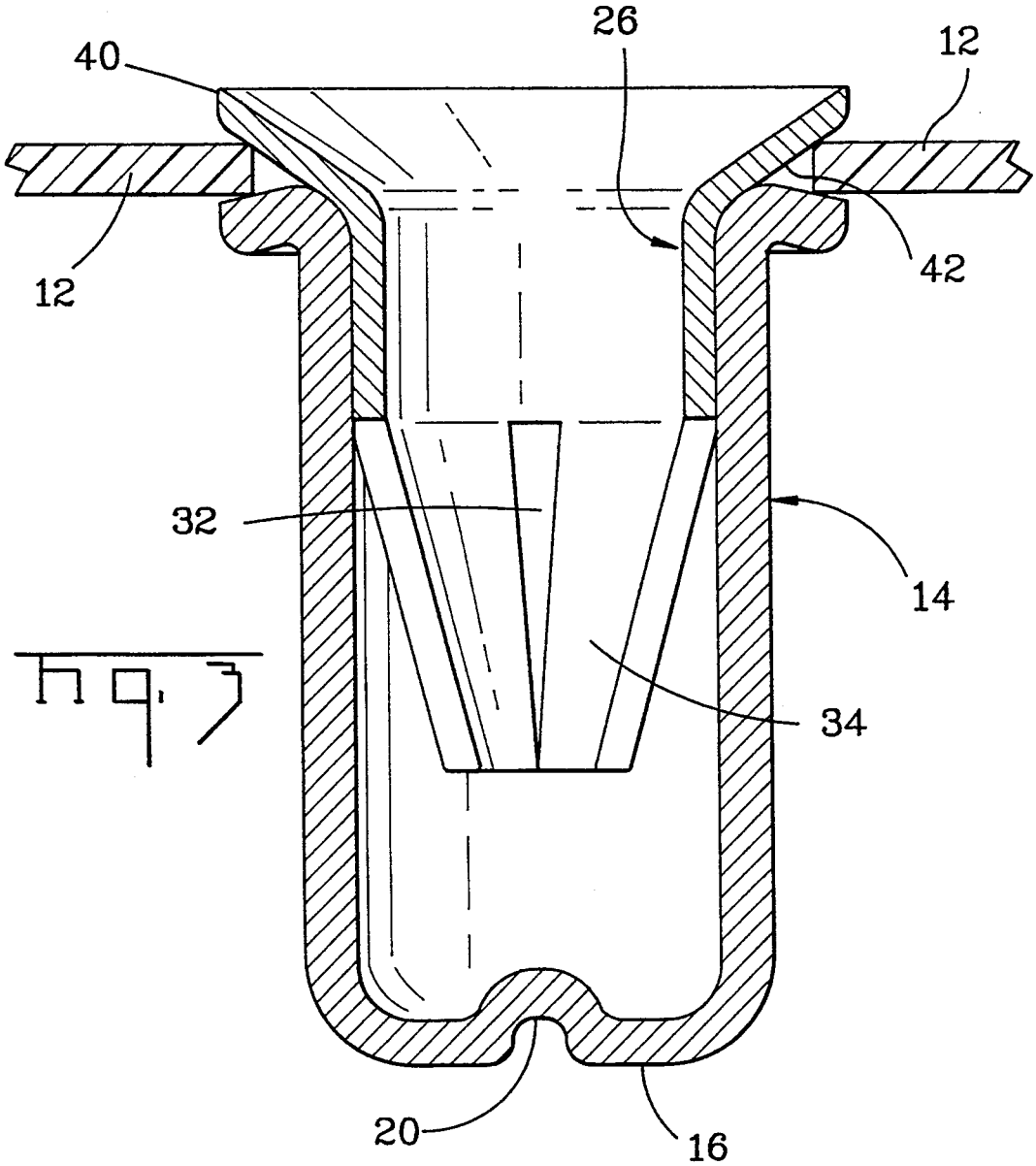
FIG. 3 is an enlarged, sectional view of an assembled pin socket system showing the removable carrier strip in position.
Figure 4:
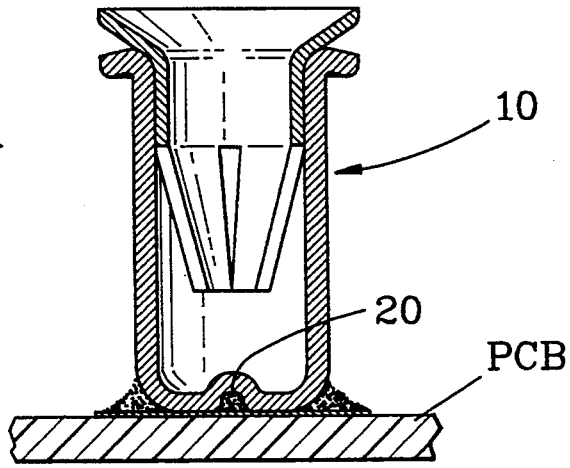
FIG. 4 is a sectional view of the assembled pin socket system illustrating the socket as soldered to a planar electronic device, such as a printed circuit board, and the removal of the carrier strip.

The invention, as depicted in the several Figures, relates to a cost effective pin socket system by the use of a pair of interfitting drawn metal members, preferably drawn from a sheet metal blank of tin plated brass. FIG. 1 illustrates an array of such interfitting members temporarily secured to a thin, plastic carrier strip. FIGS. 2 and 3 are enlarged, partially sectioned views of the socket system 10, with carrier strip 12. Such a system comprises a first drawn metal member 14, i.e. cup-shaped, having a closed end 16 and an open-end 18. The closed end 16 may be provided with an inwardly directed, central embossed portion 20, which as will be apparent later, may function to help solder the closed end 16 to a conductive electronic trace or pad along the surface of a planar electronic device, such as a PCB, see FIG. 4. Finally, in this preferred embodiment the open end 18 is characterized by an outwardly, and slightly downwardly directed, continuous flared portion 22 terminating in a peripheral edge 24.

The second element of the socket carrier system 10 of this invention is a smaller, essentially cylindrical member 26. Such member 26 comprises a continuous, mid portion 28, an open end 30 in which plural, axially oriented slots 32 have been provided. By the provisions of said slots 32, plural wall segments 34 are created, whereby such segments may be bent inwardly toward one another to reduce the opening 36 therebetween. Into such opening 36, a complementary pin may be received, as known in the art.

The opposite end 38 is characterized by an upwardly and outwardly directed, continuous flange 40. When the cylindrical member 26 is seated and press fitted into the drawn metal member 14, where the mid body portion 28 lies contiguous with the body of the metal member 14, the flange 40 cooperates with the flared portion 22 to define an annular V-slot 42 (FIG. 3), which temporarily receives the removable plastic carrier strip 12. More precisely, the carrier strip 12 includes an array of holes 44, arranged in a predetermined pattern to reflect the pattern of socket systems to be soldered to the PCB, as known in the art, where the diameter of the holes 44 is slightly less than the diameter of the flange 40. By this arrangement, and the flexible, yielding nature of the plastic strip 12, such strip may be readily removed, such as by peeling, after soldering of the socket systems 10 to the PCB.

Figure 5:
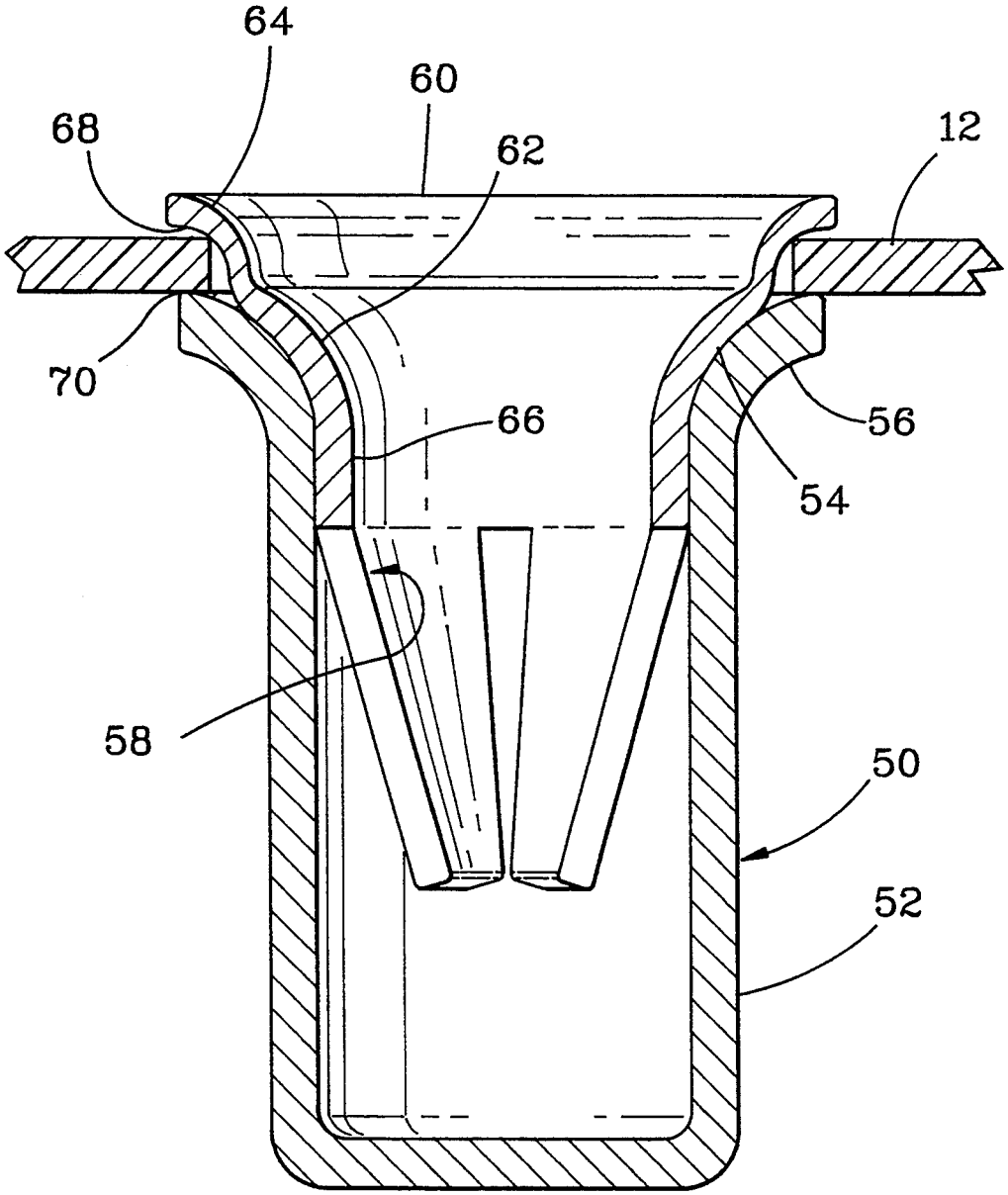
FIG. 5 is an enlarged sectional view, similar to FIG. 3, showing an alternate embodiment for the pin socket system.

FIG. 5 represents an alternate embodiment to the socket system of this invention. The alternate socket system 50 thereof comprises a first drawn metal member 52 that is cup-shaped, where the open end 54 is flared 56, upwardly and outwardly through a predetermined radius. The second element thereof is a smaller, essentially cylindrical member 58. A feature thereof, different from its counterpart in FIG. 3, is the provision of its open end 60 having first and second flared portions 62, 64. The first or inner flared portion 62 is flared from the body portion 66 upwardly and outwardly in a radial path comparable to said predetermined radius of the flared end 56 so that both the body portion 66 and flared portion 62 lie contiguous with the flared end 56 and cylindrical body of the first drawn metal member 52 when press fitted therewithin. The second flared portion 64 extending upwardly and outwardly above or beyond the first flared portion 62 defines an annular slot 68 with the edge 70 of flared end 56, where slot 68 is intended to accommodate a removable plastic carrier strip 12.

I claim:

1. A pin socket carrier system for positioning and mounting an array of pin receiving sockets to a planar electronic device, said system comprising a plurality of first drawn metal cup-shaped sockets having a closed end and an outwardly flanged open end, a like plurality of second drawn metal cylindrical sockets mounted at least partially in said first drawn metal cup-shaped sockets, each said second drawn metal cylindrical socket being characterized at one end thereof by plural axial slots to define plural wall sections, where said wall sections are angled inwardly to electrically contact an electronic pin inserted therein, and at the opposite end at least a first outwardly flared portion, where said first flared portion is configured to lie contiguous with at least a part of said outwardly flared open end, and a flexible plastic carrier strip having a plurality of holes arranged in a predetermined pattern to receive and releasably retain the assembled sockets, where said carrier strip is positioned between said outwardly flared open end and the outwardly flared portion of said second drawn metal cylindrical socket.

2. The pin socket carrier system according to claim 1, wherein said second drawn metal cylindrical sockets include a second upwardly flared portion above and extending from said first flared portion.

3. The pin socket carrier system according to claim 1, wherein said first drawn metal cup-shaped sockets include a flat bottom wall for soldering to a complementary pad along a printed circuit board.

4. The pin socket carrier system according to claim 3, wherein said bottom wall includes an embossed recess for retention of said solder.

5. The pin socket carrier system according to claim 2, wherein said carrier strip is temporarily retained between said outwardly flared open end and said second outwardly flared portion.

* * * * *